US011482154B2

(12) United States Patent
Huang et al.

(10) Patent No.: US 11,482,154 B2
(45) Date of Patent: Oct. 25, 2022

(54) METHOD, APPARATUS AND DEVICE FOR ACQUIRING LUMINANCE COMPENSATION DATA

(71) Applicant: Bazhou Yungu Electronics Technology Co., Ltd., Hebei (CN)

(72) Inventors: Wenying Huang, Langfang (CN); Cong Ma, Langfang (CN)

(73) Assignee: Bazhou Yungu Electronics Technology Co., Ltd., Langfang (CN)

( * ) Notice: Subject to any disclaimer, the term of this patent is extended or adjusted under 35 U.S.C. 154(b) by 0 days.

(21) Appl. No.: 17/467,803

(22) Filed: Sep. 7, 2021

(65) Prior Publication Data

US 2021/0407371 A1 Dec. 30, 2021

Related U.S. Application Data

(63) Continuation of application No. PCT/CN2020/084909, filed on Apr. 15, 2020.

(30) Foreign Application Priority Data

Aug. 30, 2019 (CN) ..... 201910813622.9

(51) Int. Cl.
*G09G 3/20* (2006.01)

(52) U.S. Cl.
CPC ... *G09G 3/2074* (2013.01); *G09G 2320/0233* (2013.01); *G09G 2360/16* (2013.01)

(58) Field of Classification Search
CPC ..... G09G 3/2074; G09G 2320/0233; G09G 2360/16
See application file for complete search history.

(56) References Cited

U.S. PATENT DOCUMENTS 10,121,408 B2 11/2018 Deng
2009/0135211 A1 5/2009 Wang et al.
(Continued)

FOREIGN PATENT DOCUMENTS

CN 103792704 A 5/2014
CN 105741762 A 7/2016
(Continued)

OTHER PUBLICATIONS

The International search report for PCT Application No. PCT/CN2020/084909, dated Jun. 30, 2020, 14 pages.
(Continued)

*Primary Examiner* — Kenneth B Lee, Jr.
(74) *Attorney, Agent, or Firm* — Maier & Maier, PLLC

(57) ABSTRACT

A method for acquiring luminance compensation data, which includes: collecting an image of a first grayscale value and an image of a second grayscale value displayed by a display panel to be compensated; calculating a luminance difference between the image of the first grayscale value and image of the second grayscale value for each display unit of the display panel; determining a target luminance difference based on the luminance difference between the image of the first grayscale value and the image of the second grayscale value for each display unit; determining a preset compensation data calculation scheme corresponding to the display panel and acquiring images of grayscale values required by the preset compensation data calculation scheme, based on a preset condition that the target luminance difference meets; and determining the luminance compensation data for the display panel, based on the determined images of grayscale values.

15 Claims, 3 Drawing Sheets

(56) References Cited

U.S. PATENT DOCUMENTS

| | | | | |
|---|---|---|---|---|
| 2015/0170607 | A1* | 6/2015 | Shin | G09G 3/3406 345/690 |
| 2017/0206821 | A1 | 7/2017 | Lee et al. | |

FOREIGN PATENT DOCUMENTS

| | | | |
|---|---|---|---|
| CN | 106847157 | A | 6/2017 |
| CN | 107564471 | A | 1/2018 |
| CN | 107591134 | A | 1/2018 |
| CN | 107845370 | A | 3/2018 |
| CN | 107993616 | A | 5/2018 |
| CN | 105895043 | B | 8/2018 |
| CN | 108766372 | A | 11/2018 |
| CN | 109036275 | A | 12/2018 |
| CN | 109147685 | A | 1/2019 |
| CN | 109616049 | A | 4/2019 |
| CN | 109658900 | A | 4/2019 |
| CN | 109754770 | A | 5/2019 |
| CN | 110136649 | A | 8/2019 |
| CN | 110459162 | A | 11/2019 |
| WO | 2019071776 | A1 | 4/2019 |

OTHER PUBLICATIONS

The First Office Action for China Application No. 201910813622.9, dated Feb. 22, 2021, 7 pages.

The Notice of Allowance and supplementary search report for China Application No. 201910813622.9, dated Jun. 29, 2021, 7 pages.

Chih-Lung Lin et al. "Reducing OLED Degradation Using Self-Compensated Circuit for AMOLED Displays", IEEE Electron Device Letters, vol. 32, No. 10, dated Aug. 30, 2011, 3 pages.

Xingzhi Yao et al. "Research and Implementation of OLED Optical Compensation Algorithm Based on CCD Image", China Master's Theses Full-text Database No. 1, dated Jan. 15, 2019, 59 pages.

* cited by examiner

METHOD, APPARATUS AND DEVICE FOR ACQUIRING LUMINANCE COMPENSATION DATA

CROSS REFERENCE TO RELATED APPLICATION

The application is a continuation of International Application No. PCT/CN2020/084909 filed on Apr. 15, 2020, which claims the benefit of priority to Chinese Patent Application No. 201910813622.9 filed on Aug. 30, 2019 and entitled "METHOD, APPARATUS AND DEVICE FOR ACQUIRING LUMINANCE COMPENSATION DATA", both of which are incorporated herein by reference in their entireties.

TECHNICAL FIELD

The application relates to the field of display technology, and particularly to a method, apparatus and device for acquiring luminance compensation data.

BACKGROUND

A display panel may have a Mura defect caused by factors, such as production techniques, during a production process of the display panel. Mura refers to a phenomenon of various traces caused by uneven luminance of the display panel. In order to remedy the Mura defect of the display panel, it is usually necessary to perform luminance compensation for the display panel. However, in the related art, multiple grayscale images are generally used to acquire luminance compensation data, so as to compensate all display panels in the same manner. In this manner, each of the display panels cannot be matched optimally, and the manner is time consuming and has a low efficiency.

How to optimize the approach for luminance compensation for each of the display panels has become an urgent problem to be solved at present.

SUMMARY

In a first aspect, the present application provides a method for acquiring luminance compensation data, to be applied to a display panel to be compensated. The display panel includes a plurality of display units. The method for acquiring luminance compensation data includes: collecting an image of a first grayscale value and an image of a second grayscale value displayed by the display panel; calculating a luminance difference between the image of the first grayscale value and the image of the second grayscale value for each of the display units of the display panel, based on the collected image of the first grayscale value and image of the second grayscale value; determining a target luminance difference based on the luminance difference between the image of the first grayscale value and the image of the second grayscale value for each of the display units; determining a preset compensation data calculation scheme corresponding to the display panel and acquiring images of grayscale values required by the preset compensation data calculation scheme, based on a preset condition that the target luminance difference meets; and determining the luminance compensation data for the display panel, based on the acquired images of grayscale values.

The method for acquiring luminance compensation data provided by the first aspect of the present application, before determining the luminance compensation data for the display panel to be compensated, selects an appropriate preset compensation data calculation scheme, by analyzing the luminance difference between the image of the first grayscale value and the image of the second grayscale value for each of the display units of the display panel, and acquires images of grayscale values corresponding to the scheme to process and acquire the luminance compensation data. The method can thus select an appropriate scheme for different display panels to be compensated. As compared with approaches in the related art, which require collecting multiple (usually no less than six) images of different grayscale values firstly and determine luminance compensation data based on the multiple images of different grayscale values, and the calculation scheme for which is thus complex, the method for acquiring luminance compensation data according to embodiments of the present application can improve highly the efficiency for acquiring luminance compensation data.

In a second aspect, the present application provides an apparatus for acquiring luminance compensation data, to be applied to a display panel to be compensated. The display panel includes a plurality of display units. The apparatus for acquiring luminance compensation data includes: a collection module, configured to collect an image of a first grayscale value and an image of a second grayscale value displayed by the display panel; a calculation module, configured to calculate a luminance difference between the image of the first grayscale value and the image of the second grayscale value for each of the display units of the display panel, based on the image of the first grayscale value and the image of the second grayscale value; a first determination module, configured to determine a target luminance difference based on the luminance difference between the image of the first grayscale value and the image of the second grayscale value for each of the display units; a second determination module, configured to determine a preset compensation data calculation scheme corresponding to the display panel and acquire images of grayscale values required by the preset compensation data calculation scheme, based on a preset condition that the target luminance difference meets; and a third determination module, configured to determine the luminance compensation data for the display panel, based on the acquired images of grayscale values.

In a third aspect, the present application provides a device for acquiring luminance compensation data. The device includes: a processor; and a memory, having computer program instructions stored thereon. The processor, when executing the computer program instructions, implements the method for acquiring luminance compensation data according to any of the above embodiments.

BRIEF DESCRIPTION OF THE DRAWINGS

Features, advantages, and technical effects of embodiments of the present application will be described with reference to the accompanying drawings below. The accompanying drawings are not drawn to real scale.

DETAILED DESCRIPTION

Figure 1:
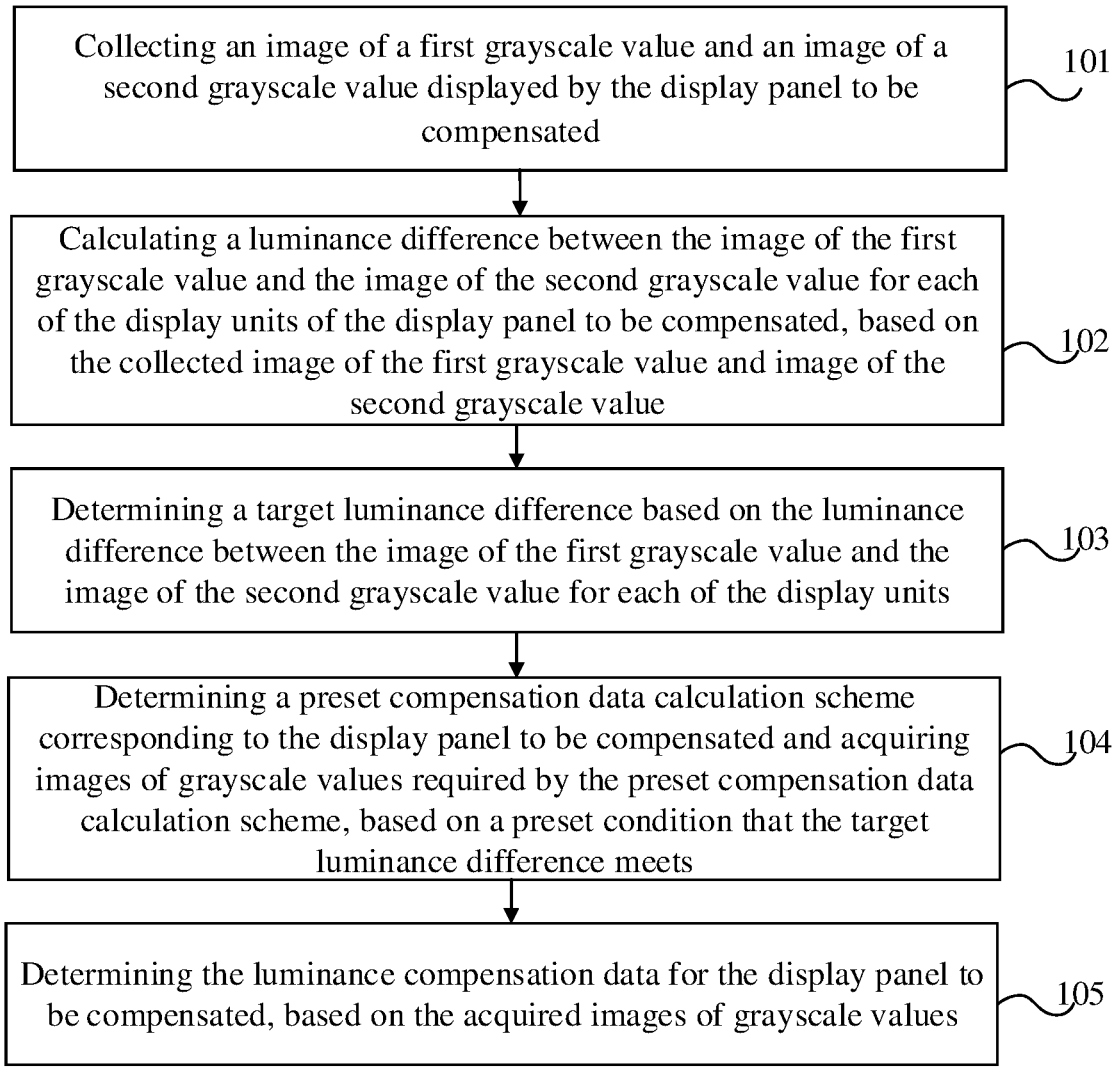
FIG. 1 is a flowchart of a method for acquiring luminance compensation data provided by an embodiment of the present application.

Features and exemplary embodiments according to various aspects of the present application will be described in details below. In the drawings and the following description, at least a part of well-known structures and technologies are not shown, in order to avoid unnecessary obscurity of the present application. In addition, the features, structures or characteristics described below may be combined in any suitable manner in one or more embodiments.

The method, apparatus, and device for acquiring luminance compensation data according to embodiments of the disclosure will be described below in details with reference to FIGS. 1 to 4.

FIG. 1 is a flowchart of a method for acquiring luminance compensation data provided by an embodiment of the present application. The method for acquiring luminance compensation data of the embodiment of the present application is to be applied to a display panel to be compensated. The display panel to be compensated includes a plurality of display units. Each of the display units refers to a small display area formed by dividing a display area of the display panel to be compensated. Each display unit may include one or more sub-pixels. The display panel to be compensated may be a Liquid Crystal Display (LCD), or other types of display panels such as Organic Light-Emitting Diode (OLED) and Micro-LED, etc. The display panel may provided with a plurality of pixels arranged in an array, and each pixel may include red, green and blue sub-pixels.

As shown in FIG. 1, the method for acquiring luminance compensation data of the embodiment of the present application may include the following steps.

In Step 101, an image of a first grayscale value and an image of a second grayscale value displayed by the display panel to be compensated are collected.

In a particular embodiment, the image of the first grayscale value displayed by the display panel to be compensated may be collected by an image collection apparatus, when the display panel to be compensated is being controlled to display the image of the first grayscale value; and the image of the second grayscale value displayed by the display panel to be compensated may be collected by the image collection apparatus, when the display panel to be compensated is being controlled to display the image of the second grayscale value. Luminance data of each of the display units displaying the image of the first grayscale value and the image of the second grayscale value may be obtained by image collection.

As shown in FIG. 1, the method of the embodiment of the present application may include, in Step 102, calculating a luminance difference between the image of the first grayscale value and the image of the second grayscale value for each of the display units of the display panel to be compensated, based on the collected image of the first grayscale value and image of the second grayscale value.

In the step, a data processing apparatus, such as a computer, may be used to calculate the luminance difference between the image of the first grayscale value and the image of the second grayscale value for each of the display units, based on luminance data of the image of the first grayscale value and image of the second grayscale value obtained in above Step 101.

As shown in FIG. 1, the method of the embodiment of the present application may include, in Step 103, determining a target luminance difference based on the luminance difference between the image of the first grayscale value and the image of the second grayscale value for each of the display units.

Optionally, the target luminance difference may be an absolute value of a mean value of luminance differences between the image of the first grayscale value and the image of the second grayscale value for a plurality of the display units. This calculation process of the target luminance difference is relatively simple, and thus the efficiency and accuracy for processing data may be improved. Alternatively, the target luminance difference may be an absolute value of the luminance difference between the image of the first grayscale value and the image of the second grayscale value for a part of the display units as the target luminance difference. For example, the mean value may be calculated after some abnormal data are eliminated, so as to improve accuracy of the calculation of the target luminance difference. The target luminance difference may also be an absolute value of a median of the luminance difference between the image of the first grayscale value and the image of the second grayscale value for each of the display units as the target luminance difference. This calculation process of the target luminance difference is relatively simple, and thus the efficiency and accuracy for processing data may be improved. The target luminance difference may also be determined in any other suitable manners.

As shown in FIG. 1, the method of the embodiment of the present application may include, in Step 104, determining a preset compensation data calculation scheme corresponding to the display panel and acquiring images of grayscale values required by the preset compensation data calculation scheme, based on a preset condition that the target luminance difference meets.

According to embodiments of the present application, several conditions may be preset for the target luminance difference, and corresponding relationships between different preset conditions and preset compensation data calculation schemes may be established. The number and/or gray values of the images of gray values required by different preset compensation data calculation schemes may be different.

In this step, the preset compensation data calculation scheme corresponding to the display panel to be compensated may be determined and the images of grayscale values required by the preset compensation data calculation scheme may be acquired, based on the preset condition that the target luminance difference meets. That is, the preset compensation data calculation scheme suitable for the display panel to be compensated and the images of grayscale values required by the scheme may be selected by this step. In the embodiment, because different compensation data calculation schemes need to process different data, selecting a suitable compensation data calculation scheme for different display panels to be compensated may improve processing efficiency, and in turn, the luminance compensation data may be determined by the compensation data calculation scheme.

As shown in FIG. 1, the method of the embodiment of the present application may include, in Step 105, determining the luminance compensation data for the display panel to be compensated, based on the acquired images of grayscale values.

The preset compensation data calculation scheme is determined and the required images of grayscale values are acquired in above Step 104. In Step 105, the required images of grayscale values as acquired may be inputted into a computer having a software for determining luminance compensation data installed thereon, for processing, to generate the luminance compensation data for the display panel to be compensated. The software for determining luminance compensation data installed on the computer is not limited herein, which may be any software that can determine the luminance compensation data by grayscale images.

In the embodiment, the image of the first grayscale value and the image of the second grayscale value displayed by the display panel to be compensated are collected, and the luminance difference between the image of the first grayscale value and the image of the second grayscale value for each of the display units of the display panel to be compensated is calculated; subsequently, the target luminance difference is determined through the luminance difference between the image of the first grayscale value and the image of the second grayscale value for each of the display units, and the preset compensation data calculation scheme corresponding to the display panel is determined and the images of grayscale values required by the preset compensation data calculation scheme are acquired based on the preset condition that the target luminance difference meets; and the luminance compensation data for the display panel to be compensated may be determined based on the acquired images of grayscale values. The method for acquiring luminance compensation data of the embodiment, before determining the luminance compensation data for the display panel to be compensated, selects an appropriate preset compensation data calculation scheme, by analyzing the luminance difference between the image of the first grayscale value and the image of the second grayscale value for each of the display units of the display panel, and acquires images of grayscale values corresponding to the scheme to process and acquire the luminance compensation data. The method can thus select an appropriate scheme for different display panels to be compensated. As compared with approaches in the related art, which require collecting multiple (usually no less than six) images of different grayscale values firstly and determine luminance compensation data based on the multiple images of different grayscale values, and the calculation scheme for which is thus complex, the method for acquiring luminance compensation data of the embodiment can improve highly the efficiency for acquiring luminance compensation data.

Optionally, each of the display units may include a sub-pixel, so as to improve the accuracy of the luminance compensation data.

Optionally, Step 103 may determine an absolute value $|N|$ of a mean value N of the luminance difference between the image of the first grayscale value and the image of the second grayscale value for each of the display units as the target luminance difference.

In the following embodiments, the target luminance difference determined as the absolute value $|N|$ of the mean value N of the luminance difference between the image of the first grayscale value and the image of the second grayscale value for each of the display units, is taken as an example for description.

Figure 2:
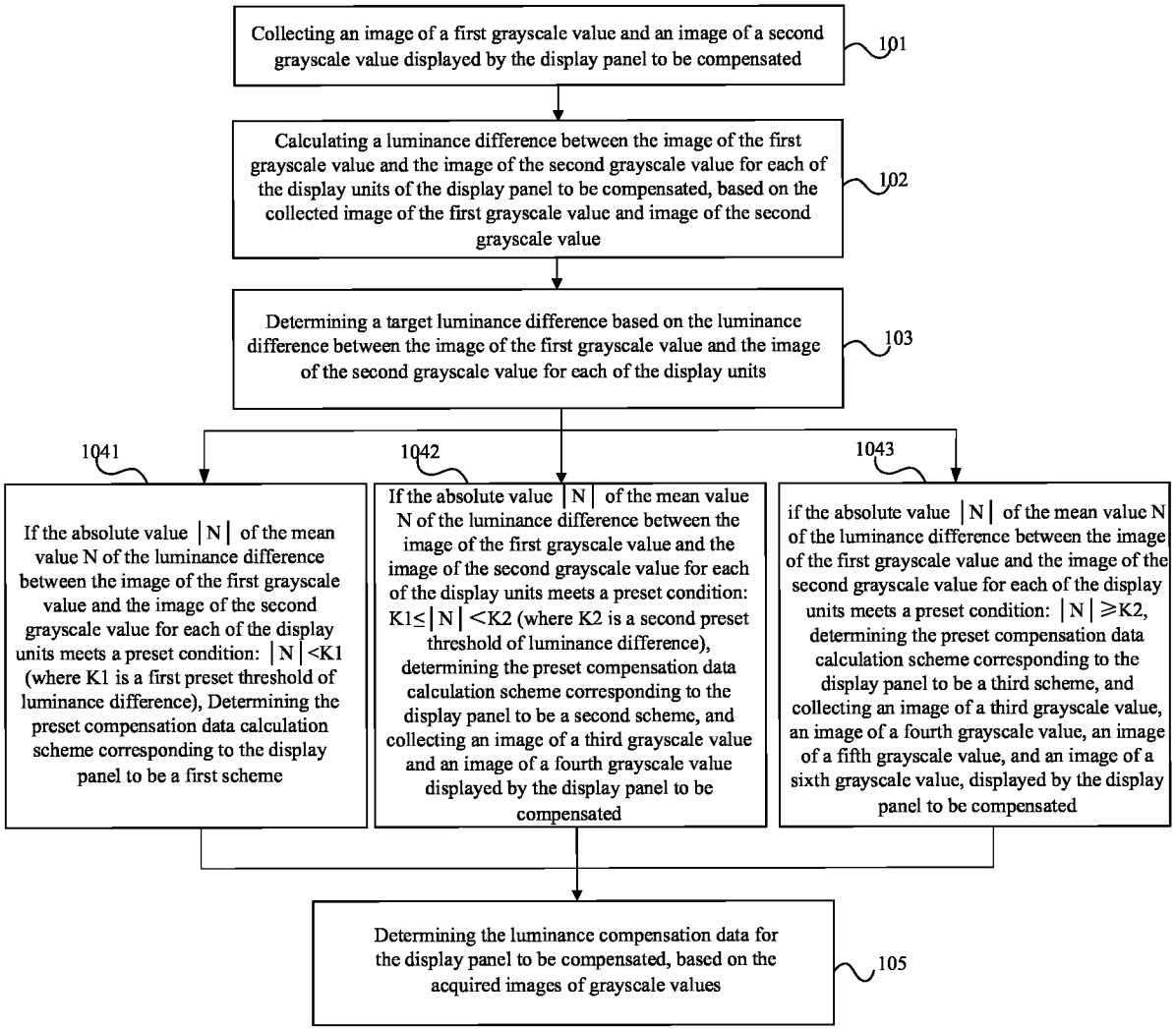
FIG. 2 is a flowchart of a method for acquiring luminance compensation data provided by another embodiment of the present application.

Reference is made to FIG. 2, which is a flowchart of a method for acquiring luminance compensation data provided by another embodiment of the present application.

FIG. 2 is different from FIG. 1 in that Step 104 shown in FIG. 1 may be implemented particularly as Steps 1041 to 1043 shown in FIG. 2.

In particular, Step 104 may include the following steps.

In Step 1041, if the absolute value $|N|$ of the mean value N of the luminance difference between the image of the first grayscale value and the image of the second grayscale value for each of the display units meets a preset condition: $|N|<K1$ (where K1 is a first preset threshold of luminance difference), the preset compensation data calculation scheme corresponding to the display panel is determined as a first scheme.

In this step, the images of grayscale values required by the first scheme may include the image of the first grayscale value and the image of the second grayscale value.

In the embodiment, it is determined that the first scheme of preset compensation data calculation schemes is adopted to acquire the luminance compensation data for the display panel to be compensated, according to that the absolute value $|N|$ of the mean value N meets the preset condition: $|N|<K1$, and the images of grayscale values required by the first scheme include the image of the first grayscale value and the image of the second grayscale value. There is no need to obtain the image of the first grayscale value and the image of the second grayscale value in this step, since they have been obtained in Step 101. The image of the first grayscale value and the image of the second grayscale value may be inputted directly into a computer having a software for determining luminance compensation data installed thereon for processing. The luminance compensation data for the display panel to be compensated may be determined by the two images.

Further, Step 104 may include, in Step 1042, if the absolute value $|N|$ of the mean value N of the luminance difference between the image of the first grayscale value and the image of the second grayscale value for each of the display units meets a preset condition: $K1\leq|N|<K2$ (where K2 is a second preset threshold of luminance difference), determining the preset compensation data calculation scheme corresponding to the display panel to be a second scheme, and collecting an image of a third grayscale value and an image of a fourth grayscale value displayed by the display panel to be compensated.

In this step, the images of grayscale values required by the second scheme may include the image of the first grayscale value, the image of the second grayscale value, the image of the third grayscale value, and the image of the fourth grayscale value. Both the third grayscale value and the fourth grayscale value are between the first grayscale value and the second grayscale value.

In the embodiment, it is determined that the second scheme of preset compensation data calculation schemes is adopted to acquire the luminance compensation data for the display panel to be compensated, depending on that the absolute value $|N|$ of the mean value N meets the preset condition: $K1\leq|N|<K2$, and the images of grayscale values required by the second scheme include the image of the first grayscale value, the image of the second grayscale value, the image of the third grayscale value, and the image of the fourth grayscale value. Only the image of the third grayscale value and the image of the fourth grayscale value are needed to be obtained in this step, since the first grayscale value and the image of the second grayscale value have been obtained in Step 101. The image of the first grayscale value, the image of the second grayscale value, the image of the third grayscale value, and the image of the fourth grayscale value may then be inputted into a computer having a software for determining luminance compensation data installed thereon for processing. The luminance compensation data for the display panel to be compensated may be determined by the four images.

Furthermore, Step 104 may include, in Step 1043, if the absolute value |N| of the mean value N of the luminance difference between the image of the first grayscale value and the image of the second grayscale value for each of the display units meets a preset condition: |N|≥K2, determining the preset compensation data calculation scheme corresponding to the display panel to be a third scheme, and collecting an image of a third grayscale value, an image of a fourth grayscale value, an image of a fifth grayscale value, and an image of a sixth grayscale value, displayed by the display panel to be compensated.

In this step, the images of grayscale values required by the third scheme may include the image of the first grayscale value, the image of the second grayscale value, the image of the third grayscale value, the image of the fourth grayscale value, the image of the fifth grayscale value, and the image of the sixth grayscale value. Both the fifth grayscale value and the sixth grayscale value are between the three grayscale value and the fourth grayscale value.

In the embodiment, it is determined that the third scheme of preset compensation data calculation schemes is adopted to acquire the luminance compensation data for the display panel to be compensated, depending on that the absolute value |N| of the mean value N meets the preset condition: |N|≥K2, and the images of grayscale values required by the third scheme include the image of the first grayscale value, the image of the second grayscale value, the image of the third grayscale value, the image of the fourth grayscale value, the image of the fifth grayscale value, and the image of the sixth grayscale value. Only the image of the third grayscale value, the image of the fourth grayscale value, the image of the fourth grayscale value, and the image of the sixth grayscale value are needed to be obtained in this step, since the first grayscale value and the image of the second grayscale value have been obtained in Step 101. The image of the first grayscale value, the image of the second grayscale value, the image of the third grayscale value, the image of the fourth grayscale value, the image of the fifth grayscale value, and the image of the sixth grayscale value may then be inputted into a computer having a software for determining luminance compensation data installed thereon for processing. The luminance compensation data for the display panel to be compensated may be determined by the six images.

In the above embodiment, depending on the preset conditions satisfied by the absolute value |N| of the mean value N of the luminance difference between the image of the first grayscale value and the image of the second grayscale value for each of the display units, an appropriate preset compensation data calculation scheme is selected to acquire the luminance compensation data for the display panel to be compensated. The efficiency may be improved and a complex calculation process may be avoided, by selecting a particular preset compensation data calculation scheme for a particular display panel.

Optionally, the first grayscale value, the second grayscale value, the third grayscale value, the fourth grayscale value, the fifth grayscale value, and the sixth grayscale value may be 32, 224, 64, 192, 96, and 160, respectively.

Optionally, the first preset threshold K1 of luminance difference and the second preset threshold K2 of luminance difference may be chosen based on experience, or may be obtained through calculation. Particularly, a large number of samples of display panels to be compensated may be collected and processed. Each of the samples may be controlled to display the image of the first grayscale value and the image of the second grayscale value. A luminance difference between the image of the first grayscale value and the image of the second grayscale value for each display unit (for example, each sub-pixel) of each of the samples may be obtained. A mean value of the luminance difference between the image of the first grayscale value and the image of the second grayscale value for each display unit of each of the samples may be calculated. Compensation data acquired using the image of the first grayscale value and the image of the second grayscale value may then be used for luminance compensation of the sample. The samples may be classified based on the compensation effects of the compensated samples. The maximum mean value of multiple samples with better compensation effects may be determined as the first preset threshold K1 of luminance difference. Subsequently, the samples with poor compensation effects may be controlled to display the image of the third grayscale value and the image of the fourth grayscale value. Luminance compensation data acquired based on the image of the first grayscale value, the image of the second grayscale value, the image of the third grayscale value, and the image of the fourth grayscale value of each sample may be used to compensate the corresponding sample. These samples may then be classified again based on the compensation effects. The maximum mean value of multiple samples with better compensation effects among these samples may be determined as the second preset threshold K2 of luminance difference.

It is also possible to continue to obtain other preset thresholds of luminance difference in the above manner, as required. Correspondingly, the foregoing embodiments may further add preset conditions and acquire more images of grayscale values to acquire luminance compensation data. However, making a comprehensive consideration of the processing efficiency, it is enough to satisfy the requirements of accuracy and efficiency for luminance compensation, by setting three preset conditions.

Optionally, a size of a flash memory of the display panel to be complemented may be determined based on the images of grayscale values required by the preset compensation data calculation scheme corresponding to the display panel. For example, the size of the flash memory may be positively correlated with the number of the required images of grayscale values.

In this embodiment, since the greater the number of the required images of grayscale values, the larger the memory that the acquired luminance compensation data occupies, a flash memory with a suitable size may be selected based on the required images of grayscale values, to reduce production costs.

The luminance compensation data determined in the above embodiments may be stored in the flash memory. When the display panel to be compensated is in a practical working state, a chip of the display panel to be compensated may read the luminance compensation data from the flash memory, to perform luminance compensation for the display panel to be compensated, so as to reduce or even eliminate Mura and improve the display effect.

Figure 3:
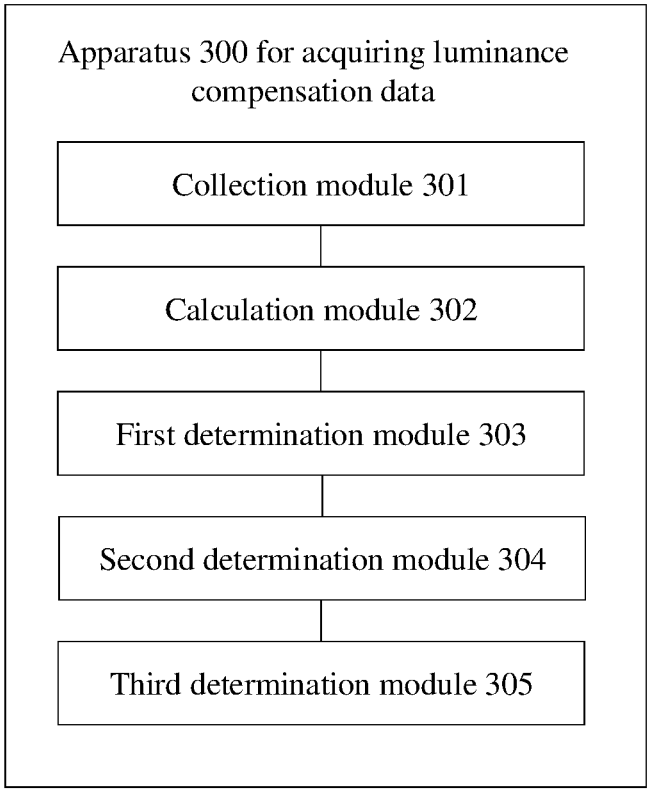
FIG. 3 is a structural block diagram of an apparatus for acquiring luminance compensation data provided by an embodiment of the present application.

Embodiments of the present disclosure also provide an apparatus 300 for acquiring luminance compensation data. The apparatus 300 is to be applied to a display panel to be compensated. The display panel includes a plurality of display units. Reference is made to FIG. 3, which is a structural block diagram of an apparatus for acquiring luminance compensation data provided by an embodiment of the present application. The apparatus 300 for acquiring luminance compensation data may include a collection module 301, a calculation module 302, a first determination module 303, a second determination module 304, and a third determination module 305.

The collection module 301 is configured to collect an image of a first grayscale value and an image of a second grayscale value displayed by the display panel to be compensated.

The calculation module 302 is configured to calculate a luminance difference between the image of the first grayscale value and the image of the second grayscale value for each of the display units of the display panel to be compensated, based on the image of the first grayscale value and the image of the second grayscale value.

The first determination module 303 is configured to determine a target luminance difference based on the luminance difference between the image of the first grayscale value and the image of the second grayscale value for each of the display units to be compensated.

The second determination module 304 is configured to determine a preset compensation data calculation scheme corresponding to the display panel to be compensated and acquire images of grayscale values required by the preset compensation data calculation scheme, based on a preset condition that the target luminance difference meets.

The third determination module 305 is configured to determine the luminance compensation data for the display panel to be compensated, based on the acquired images of grayscale values.

In the embodiment, the image of the first grayscale value and the image of the second grayscale value displayed by the display panel to be compensated are collected by the collection module 301, and the luminance difference between the image of the first grayscale value and the image of the second grayscale value for each of the display units of the display panel to be compensated is calculated by the calculation module 302; subsequently, the target luminance difference is determined by the first determination module 303 based on the luminance difference between the image of the first grayscale value and the image of the second grayscale value for each of the display units, and the preset compensation data calculation scheme corresponding to the display panel is determined and the images of grayscale values required by the preset compensation data calculation scheme are acquired by the second determination module 304 based on the preset condition that the target luminance difference meets; and the luminance compensation data for the display panel to be compensated may be determined by the third determination module 305 based on the acquired images of grayscale values. The apparatus for acquiring luminance compensation data of the embodiment, before determining the luminance compensation data for the display panel to be compensated, selects an appropriate preset compensation data calculation scheme, by analyzing the luminance difference between the image of the first grayscale value and the image of the second grayscale value for each of the display units of the display panel, and acquires images of grayscale values corresponding to the scheme to process and acquire the luminance compensation data. The apparatus can thus select an appropriate scheme for different display panels to be compensated. As compared with approaches in the related art, which require collecting multiple (usually no less than six) images of different grayscale values firstly and determine luminance compensation data based on the multiple images of different grayscale values, and the calculation scheme for which is thus complex, the apparatus for acquiring luminance compensation data of the embodiment can improve highly the efficiency for acquiring luminance compensation data.

Optionally, the second determination module 304 may be further configured to determine that the preset compensation data calculation scheme corresponding to the display panel to be compensated is a first scheme, when the preset condition is that the target luminance difference is less than a first preset threshold K1 of luminance difference. The images of grayscale values required by the first scheme include the image of the first grayscale value and the image of the second grayscale value.

Alternatively, the second determination module 304 may be further configured to: determine that the preset compensation data calculation scheme corresponding to the display panel to be compensated is a second scheme, when the preset condition is that the target luminance difference is greater than or equal to a first preset threshold K1 of luminance difference and less than a second preset threshold K2 of luminance difference, wherein the images of grayscale values required by the second scheme include the image of the first grayscale value and the image of the second grayscale value, an image of a third grayscale value, and an image of a fourth grayscale value, and both the third grayscale value and the fourth grayscale value are between the first grayscale value and the second grayscale value; and collect the image of the third grayscale value and the image of the fourth grayscale value displayed by the display panel.

Alternatively, the second determination module 304 may be further configured to: determine that the preset compensation data calculation scheme corresponding to the display panel is a third scheme, when the preset condition is that the target luminance difference is greater than or equal to a second preset threshold K2 of luminance difference, wherein the images of grayscale values required by the third scheme include the image of the first grayscale value and the image of the second grayscale value, an image of a third grayscale value, an image of a fourth grayscale value, an image of a fifth grayscale value, and an image of a sixth grayscale value, and both the fifth grayscale value and the sixth grayscale value are between the third grayscale value and fourth grayscale value; and collect the image of the third grayscale value, the image of the fourth grayscale value, the image of the fifth grayscale value, and the image of the sixth grayscale value displayed by the display panel.

Optionally, the target luminance difference may be an absolute value of a mean value of the luminance differences between the image of the first grayscale value and the image of the second grayscale value for a plurality of the display units.

Optionally, the first grayscale value, second grayscale value, third grayscale value, fourth grayscale value, fifth grayscale value, and sixth grayscale value may be 32, 224, 64, 192, 96, and 160, respectively.

Optionally, each of the display units may include a sub-pixel.

Optionally, the apparatus may further include a fourth determination module, configured to determine a size of a flash memory of the display panel, based on the required images of grayscale values. The size of the flash memory may be positively correlated with a number of the required images of grayscale values.

Since the embodiments of the apparatus 300 for acquiring luminance compensation data corresponds to the above embodiments of the method for acquiring luminance compensation data, the apparatus 300 for acquiring luminance compensation data may have the same beneficial effects as the method for acquiring luminance compensation data, which will not be repeated herein.

Figure 4:
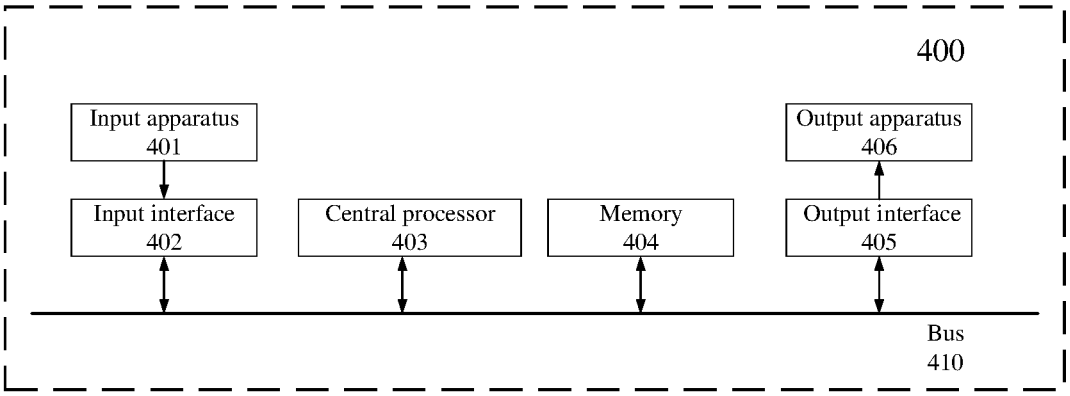
FIG. 4 is a structural diagram of an exemplary hardware architecture of a device for acquiring luminance compensation data provided by an embodiment of the present application.

The method and apparatus for acquiring luminance compensation data according to the embodiments of this specification described in conjunction with FIG. 1 to FIG. 3 may be implemented by a device for acquiring luminance compensation data. FIG. 4 is a structural diagram of an exemplary hardware architecture of a device 400 for acquiring luminance compensation data provided by an embodiment of the present application.

As shown in FIG. 4, the device 400 for acquiring luminance compensation data may include an input apparatus 401, an input interface 402, a central processor 403, a memory 404, an output interface 405, and an output apparatus 406. Among them, the input interface 402, the central processor 403, the memory 404, and the output interface 405 are connected with each other through a bus 410, and the input apparatus 401 and the output apparatus 406 are connected to the bus 410 through the input interface 402 and the output interface 405 respectively, and then connected to the other components of the device 400 for acquiring luminance compensation data.

Particularly, the input apparatus 401 may receive input information from the outside. The external input information may be an image of a first grayscale value and an image of a second grayscale value displayed by a display panel to be compensated. The input apparatus 401 may then transmit the input information to the central processor 403 through the input interface 402. The central processor 403 may process the input information based on computer executable instructions stored in the memory 404, to generate output information. The output information may be luminance compensation data. The processor 403 may store the output information in the memory 404 temporarily or permanently, and transmit the output information to the output apparatus 406 through the output interface 405. The output apparatus 406 may output the output information to the outside of the device 400 for acquiring luminance compensation data, for use by a user.

That is to say, the device 400 for acquiring luminance compensation data shown in FIG. 4 may also be implemented to include a memory having computer executable instructions stored thereon; and a processor, which, when executing the computer executable instructions, implements the method and apparatus for acquiring luminance compensation data described in conjunction with FIG. 1 to FIG. 3.

Optionally, the luminance compensation data may be transmitted to a flash memory through the output apparatus 406, and be stored in the flash memory. A chip of the display panel to be compensated may read the luminance compensation data from the flash memory, to perform luminance compensation for the display panel to be compensated, so as to reduce or even eliminate Mura and improve the display effect.

What is claimed is:

1. A method for acquiring luminance compensation data, to be applied to a display panel to be compensated, wherein the display panel comprises a plurality of display units, and the method comprises:

collecting an image of a first grayscale value and an image of a second grayscale value displayed by the display panel;

calculating a luminance difference between the image of the first grayscale value and the image of the second grayscale value for each of the display units of the display panel, based on the collected image of the first grayscale value and image of the second grayscale value;

determining a target luminance difference based on the luminance difference between the image of the first grayscale value and the image of the second grayscale value for each of the display units;

determining a preset compensation data calculation scheme corresponding to the display panel and acquiring images of grayscale values required by the preset compensation data calculation scheme, based on a preset condition that the target luminance difference meets; and determining the luminance compensation data for the display panel, based on the acquired images of grayscale values, wherein each of the display units comprises a sub-pixel.

2. The method for acquiring luminance compensation data of claim 1, wherein determining the preset compensation data calculation scheme corresponding to the display panel and acquiring the images of grayscale values required by the preset compensation data calculation scheme, based on the preset condition that the target luminance difference meets comprises:

when the preset condition is that the target luminance difference is less than a first preset threshold K1 of luminance difference, determining that the preset compensation data calculation scheme corresponding to the display panel is a first scheme, wherein the images of grayscale values required by the first scheme comprise the image of the first grayscale value and the image of the second gray scale value.

3. The method for acquiring luminance compensation data of claim 1, wherein determining the preset compensation data calculation scheme corresponding to the display panel and acquiring the images of grayscale values required by the preset compensation data calculation scheme, based on the preset condition that the target luminance difference meets comprises:

when the preset condition is that the target luminance difference is greater than or equal to a first preset threshold K1 of luminance difference and less than a second preset threshold K2 of luminance difference, determining that the preset compensation data calculation scheme corresponding to the display panel is a second scheme, wherein the images of grayscale values required by the second scheme comprise the image of the first grayscale value and the image of the second grayscale value, an image of a third grayscale value, and an image of a fourth grayscale value, and both the third grayscale value and the fourth grayscale value are between the first grayscale value and the second grayscale value, and collecting the image of the third grayscale value and the image of the fourth grayscale value displayed by the display panel.

4. The method for acquiring luminance compensation data of claim 1, wherein determining the preset compensation data calculation scheme corresponding to the display panel and acquiring the images of grayscale values required by the preset compensation data calculation scheme, based on the preset condition that the target luminance difference meets comprises:

when the preset condition is that the target luminance difference is greater than or equal to a second preset threshold K2 of luminance difference, determining that the preset compensation data calculation scheme corresponding to the display panel is a third scheme, wherein the images of grayscale values required by the third scheme comprise the image of the first grayscale value and the image of the second grayscale value, an image of a third grayscale value, an image of a fourth grayscale value, an image of a fifth grayscale value, and an image of a sixth grayscale value, both the third grayscale value and the fourth grayscale value are between the first grayscale value and the second grayscale value, and both the fifth grayscale value and the sixth grayscale value are between the third grayscale value and the fourth grayscale value, and collecting the image of the third grayscale value, the image of the fourth grayscale value, the image of the fifth grayscale value, and the image of the sixth grayscale value displayed by the display panel.

5. The method for acquiring luminance compensation data claim 4, wherein the first grayscale value, the second grayscale value, the third grayscale value, the fourth grayscale value, the fifth grayscale value, and the sixth grayscale value are 32, 224, 64, 192, 96, and 160, respectively.

6. The method for acquiring luminance compensation data of claim 1, wherein determining the target luminance difference based on the luminance difference between the image of the first grayscale value and the image of the second grayscale value for each of the display units comprises:

determining an absolute value of a mean value of the luminance differences between the image of the first grayscale value and the image of the second grayscale value for a plurality of the display units as the target luminance difference.

7. The method for acquiring luminance compensation data of claim 1, wherein determining the target luminance difference based on the luminance difference between the image of the first grayscale value and the image of the second grayscale value for each of the display units comprises:

determining an absolute value of a mean value of the luminance differences between the image of the first grayscale value and the image of the second grayscale value for a subset of the display units as the target luminance difference.

8. The method for acquiring luminance compensation data of claim 1, wherein determining the target luminance difference based on the luminance difference between the image of the first grayscale value and the image of the second grayscale value for each of the display units comprises:

determining an absolute value of a median value of luminance differences between the image of the first grayscale value and the image of the second grayscale value for a plurality of the display units as the target luminance difference.

9. The method for acquiring luminance compensation data of claim 1, further comprising:

determining a size of a flash memory of the display panel, based on the required images of gray scale values.

10. The method for acquiring luminance compensation data of claim 9, wherein the size of the flash memory is positively correlated with a number of the required images of gray scale values.

11. An apparatus for acquiring luminance compensation data, to be applied to a display panel to be compensated, wherein the display panel comprises a plurality of display units, and the apparatus comprises:

a collection module, configured to collect an image of a first grayscale value and an image of a second grayscale value displayed by the display panel;

a calculation module, configured to calculate a luminance difference between the image of the first grayscale value and the image of the second grayscale value for each of the display units of the display panel, based on the image of the first grayscale value and the image of the second gray scale value;

a first determination module, configured to determine a target luminance difference based on the luminance difference between the image of the first grayscale value and the image of the second grayscale value for each of the display units;

a second determination module, configured to determine a preset compensation data calculation scheme corresponding to the display panel and acquire images of grayscale values required by the preset compensation data calculation scheme, based on a preset condition that the target luminance difference meets; and a third determination module, configured to determine the luminance compensation data for the display panel, based on the acquired images of grayscale values, wherein each of the display units comprises a sub-pixel.

12. The apparatus for acquiring luminance compensation data of claim 11, wherein the second determination module is specifically configured to: determine that the preset compensation data calculation scheme corresponding to the display panel is a first scheme, when the preset condition is that the target luminance difference is less than a first preset threshold K1 of luminance difference, wherein the images of gray scale values required by the first scheme comprise the image of the first grayscale value and the image of the second grayscale value.

13. The apparatus for acquiring luminance compensation data of claim 11, wherein the second determination module is specifically configured to:

determine that the preset compensation data calculation scheme corresponding to the display panel is a second scheme, when the preset condition is that the target luminance difference is greater than or equal to a first preset threshold K1 of luminance difference and less than a second preset threshold K2 of luminance difference, wherein the images of grayscale values required by the second scheme comprise the image of the first grayscale value and the image of the second grayscale value, an image of a third grayscale value, and an image of a fourth grayscale value, and both the third grayscale value and the fourth grayscale value are between the first grayscale value and the second grayscale value; and collect the image of the third grayscale value and the image of the fourth grayscale value displayed by the display panel.

14. The apparatus for acquiring luminance compensation data of claim 11, wherein the second determination module is specifically configured to:

determine that the preset compensation data calculation scheme corresponding to the display panel is a third scheme, when the preset condition is that the target luminance difference is greater than or equal to a second preset threshold K2 of luminance difference, wherein the images of grayscale values required by the third scheme comprise the image of the first grayscale value and the image of the second grayscale value, an image of a third grayscale value, an image of a fourth grayscale value, an image of a fifth grayscale value, and an image of a sixth grayscale value, both the third grayscale value and the fourth grayscale value are between the first grayscale value and the second grayscale value, and both the fifth grayscale value and the sixth grayscale value are between the third grayscale value and fourth grayscale value; and collect the image of the third grayscale value, the image of the fourth grayscale value, the image of the fifth grayscale value, and the image of the sixth grayscale value displayed by the display panel.

15. A device for acquiring luminance compensation data, comprising:

a processor; and a memory, having computer program instructions stored thereon;

wherein the processor, when executing the computer program instructions, implements the method for acquiring luminance compensation data of claim 1.

* * * * *